United States Patent [19]

Elliot et al.

[11] 4,063,877

[45] Dec. 20, 1977

[54] DYEING METHODS

[75] Inventors: Alexander Elliot; John Gerald Lee, both of Huddersfield; Brian Lever, Meltham, all of England

[73] Assignee: L. B. Holliday & Co. Limited, Huddersfield, England

[21] Appl. No.: 636,711

[22] Filed: Nov. 26, 1975

[30] Foreign Application Priority Data

Dec. 2, 1974 United Kingdom ..... 52094/74

[51] Int. Cl.[2] ..... D06P 1/38; D06P 3/14

[52] U.S. Cl. ..... 8/1 A; 8/1 E; 8/1 G; 8/1 H; 8/39 R; 8/41 R; 8/54; 8/93; 8/102; 8/128 A; 8/163; 8/165

[58] Field of Search ..... 8/54, 102, 163, 165, 8/1 N, 1 E, 1 P, 1 H, 39 R, 41 R, 93, 1 A, 1 G

[56] References Cited

U.S. PATENT DOCUMENTS 3,627,475 12/1971 Baumann ..... 8/54

FOREIGN PATENT DOCUMENTS 1,204,411 9/1970 United Kingdom.

OTHER PUBLICATIONS

Schwartz et al., "Surface Active Agents and Detergents" vol. 2., (Interscience, 1958) pp. 271–272, 591–595.

Textile Chemist and Colorist, Sept. 1969, vol. 1, No. 20A, p. 253.

*Primary Examiner*—A. Lionel Clingman

*Attorney, Agent, or Firm*—William R. Liberman

[57] ABSTRACT

The invention is concerned with a change in the current practice of dyeing natural and synthetic polyamide materials with reactive dyestuffs. The invention involves pre-treating the material to be dyed with an amphoteric auxiliary in a bath which is brought rapidly to the later dyeing temperature and which contains an amphoteric auxiliary preferably at a pH buffered within a specific range. It is found that the pre-treated material takes on the reactive dyestuff very readily and that the dyed materials have a good fastness. A major achievement is that the dyeing time is cut to about one-half of that presently employed.

8 Claims, 15 Drawing Figures

Figure 1:
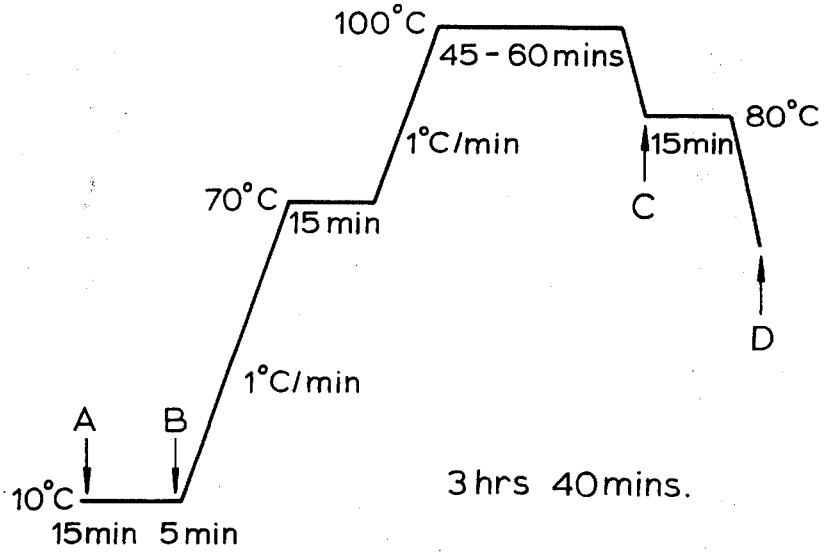

A. Add Auxiliary Products
B. Add Dyestuff
C. Add Ammonia
D. Rinse/Scour

A. Add Auxiliary Products
B. Add Dyestuff
C. Add Ammonia
D. Rinse/Scour

C.I. REACTIVE YELLOW 39 TRADITIONAL DYEING METHOD

C.I. REACTIVE YELLOW 39 LBH DYEING SYSTEM

C.I. REACTIVE ORANGE 29 TRADITIONAL DYEING METHOD

C.I. REACTIVE ORANGE 29 LBH DYEING SYSTEM

C.I. REACTIVE RED 84 TRADITIONAL DYEING METHOD.

C.I. REACTIVE RED 84 HIGH PRODUCTION DYEING SYSTEM.

C.I. REACTIVE RED 66 TRADITIONAL DYEING METHOD

C.I. REACTIVE RED 66 LBH DYEING SYSTEM

C.I. REACTIVE BLUE 69 TRADITIONAL DYEING METHOD

C.I. REACTIVE BLUE 69 LBH DYEING SYSTEM

C.I. REACTIVE BLUE 60 TRADITIONAL DYEING METHOD

C.I. REACTIVE BLUE 60 LBH DYEING SYSTEM

DYEING METHODS

This invention relates to the dyeing of natural and synthetic polyamide fibres, e.g. wool and nylon and of blends of various natural and synthetic polyamide fibres, e.g. wool/nylon blends.

The invention is particularly but not exclusively applicable to the dyeing of machine-washable wools, e.g. the so-called Superwash (trade mark) wools which include Hercosett (trade mark) treated wools, which have been developed very recently, either alone or in admixture. However, the invention is also applicable to the dyeing of natural wools and of unmixed synthetic polyamides.

The Superwash wools are difficult to dye to a sufficient level of fastness to washing to meet presentday standards of machine washability. Thus, the Superwash wools comprise wool which has been chlorinated and resin-treated. The treated wools are found to have a cationic charge on the fibre which gives problems in the application of the usual, high fastness anionic dyestuffs which are employed conventionally on wool. Thus, since the dyer has to control the rate at which the dye is taken up, the dyeing process has to be made unusually long and, particularly in the case of pale shades, there is a high risk of uneven results. There is also a high rate of "strike" of the dyestuff at low temperatures and dyestuffs of high fastness to washing do not migrate sufficiently to ensure adequate levelling on the material to commercially acceptable standards.

We have sought to avoid these difficulties inter alia in the dyeing of wool and wool mixtures, particularly in the case of the machine washable wools such as the "Superwash" and "Hercosett" wools.

According to our invention, we provide a method of dyeing a natural and/or synthetic polyamide fibre yarn or fabric (referred to herein as the "material") comprising: (i) a pretreatment before the dyeing step in which the material is contacted with an amphoteric auxiliary capable of being replaced during dyeing by the dyestuff applied to the said material; and (ii) thereafter dyeing the wool rapidly at the usual temperatures a "dyestuff" selected from the group consisting of "reactive" dyestuffs and mixtures containing at least one reactive dyestuff together with at least one other dyestuff.

The process is particularly applicable to anthraquinone and azo dyestuffs having at least one reactive group, such as an α-bromoacryloylamino group (e.g. the Lanasol (trade mark) dyes manufactured by Ciba-Geigy) or a monochlorotriazinyl or chloroacetyl group (e.g. the Cibacron (trade mark), Cibacrolan (trade mark) or Cibalan Brilliant (trade mark) dyes also of Ciba-Geigy).

One effective amphoteric auxiliary is that developed by us under the name Leveller N-R (trade mark). Leveller N-R is a low-foaming, slightly anionic amphoteric levelling agent developed by us which is used in aqueous solution. The pH of the solution is normally adjusted by means of an acid, e.g. acetic acid, to a value within the range of from 5 – 11 inclusive, e.g. substantially pH9. The material is a brown clear liquid which is easily soluble in hot or cold water and is usually employed at a phosphate buffered pH of from approximately 4 to 7, preferably from 5.75 to 6.5. The anionic properties of this amphoteric auxiliary are sufficient in our experience to overcome the cationic charges carried for example by a recently developed Superwash wool which uses Hercosett resin supplied by Hercules Inc. Leveller N-R is also effective on the machine washable wool developed by Precision Processes (Textiles) Limited of Dylan Laboratories, Ambergate, England, under their trade marks Dylan G.R.B. and G.K.C. Various other amphoteric auxiliaries may be used. Thus, for example, the Albegal (trade mark) A, B and C made by Ciba-Geigy are also suitable in the process of the invention. These materials are all amphoteric polyglycol ether derivatives or products.

The invention is not limited in any way to the Leveller or Albegal auxiliaries mentioned.

We have found that Leveller N-R is particularly suitable with the above-mentioned Lanasol and Cibacron dyestuffs on nylons, machine-washable wools and blends thereof. It will be appreciated therefore that this material is suitable not only on wools including Superwash wools but on mixtures of wools with other polyamide materials such as nylons.

It is a feature of the invention that the dyeing is effected as rapidly as possible in contrast to the present conventional practice. The dyebath contains an amphoteric auxiliary such as Leveller N-R. The goods to be dyed are added and the bath is raised to its dyeing temperature, e.g. to substantially 100° C as rapidly as possible, generally in a period of from 10 to 30 minutes, and in particular in about 20 – 25 minutes. After a short pretreatment at that temperature, the dye is added and dyeing is carried out for the conventional dyeing period. This leads to level dyeing, a high degree of penetration and a good appearance which are achieved in a short dyeing time. In particular, we find we can reduce the usual total dyeing time of about 4 hours by approximately one-half to about 2 hours.

We now refer more particularly to a method which may be successfully used with Leveller N-R on machinewashable wool and on mixtures of nylons and machinewashable wools.

The dyebath is set with a phosphate buffer mixture to give a pH of substantially 5.5 to 6.5 together with 1 to 4% Leveller N-R, depending on the shade needed. The bath is at substantially 40° to 50° C. The material to be dyed is then entered into the dyebath which is brought to the boil in 20 minutes and maintained at that temperature for a further 20 minutes. The previously well dissolved dyestuff is added, and dyeing is continued at the boil for about 45 – 60 minutes.

Various modifications may be made in the method of use. For example, in the case of the dyeing of dark shades, particularly on blends comprising low affinity nylon, it may be necessary to reduce the amount of Leveller N-R to about 2% to obtain good exhaustion and colour value.

Various tests were carried out to demonstrated the results obtained according to the invention.

CONVENTIONAL DYEING SYSTEM

A small side-paddle garment dyeing machine was filled with 180 litres of water. At 20° C the following additions were made to the dyebath:-

300 grms dessicated sodium sulphate 80 grms of a product marketed by Ciba-Geigy as Albegal (trade Mark) B and described as being amphoteric polyglycol ether derivative. Acetic acid was added until the pH was 4.

Twelve fully fashioned woollen garments (total weight of 6 kilos) which had previously been chlorinated and resin-treated to enable them to withstand machine washing were put into this dyebath and allowed to circulate for 15 minutes.

72 grms Lanasol Blue 3G (trade mark of Ciba-Geigy) and 18 grms Lanasol Yellow 4G (trade mark of Ciba-Geigy) were dissolved in boiling water and added to the dyebath. Circulation was continued for 10 minutes to enable a thorough mixing of the dye liquor and woollen garments.

The temperature of the dyebath was raised to 65° C at a rate of 1° C per minute. It was maintained at 65° C for 15 minutes. At the end of this period, two garments were withdrawn from the dyebath, the surplus moisture was removed by hydro-extraction and the garments were examined to determine if a reasonable degree of penetration had been achieved in the seams. It was decided that the seams were sufficiently penetrated for dyeing to continue. The two garments were therefore returned to the dye liquor. The time occupied by this operation was 15 minutes.

The temperature of the dyebath was then raised from 65° C to 100° C at 1° C per minute. Boiling was continued for 45 minutes at the end of which time the dyebath was cooled to 80° C at the rate of 2° C per minute and sufficient ammonia was added to adjust the pH to lie in the region of 8 to 8.5. The goods were maintained for 15 minutes in this dyebath, at the end of which time the bath was run off, and the goods were then thoroughly rinsed in cold water, during which time the pH was adjusted further by the addition of a small amount of acetic acid to lie in the region of 6 – 6.5. The total time taken was 4 hrs. 15 mins.

The garments were dyed to a turquoise blue shade and were found to be commercially acceptable in respect of general levelness of shade and seam penetration, although the seam penetration and general appearance were not perfect.

HIGH PRODUCTION OF RAPID DYEING SYSTEM

A small side-paddle garment dyeing machine was filled with 180 liter of water at 20° C. Twelve fully fashioned woollen garments having a total weight of 6 kgs, which had previously been chlorinated and resin-treated to enable them to withstand machine-washing were put into this dyebath. As the temperature was raised to 100° C., the following additions were made:-

240 grms Leveller N-R (trade mark of L. B. Holliday & Co. Ltd.)

320 grms monosodium hydrogen phosphate 216 grms disodium hydrogen phosphate

The pH of the dyebath was 6.5

The dye liquor was maintained for 20 minutes at 100° C at the end of which time:

72 grms Lanasol Blue 3G (trade mark of Ciba-Geigy) and 18 grms Lanasol Yellow 4G (Ciba-Geigy trade mark) which had been dissolved in boiling water were added to the dyebath.

Dyeing was continued for 45 minutes. The dye liquor was then cooled at 2° C per minute to 80° C at which point it was run to waste. The machine was filled with water, the goods were rinsed for 5 minutes and the machine was finally emptied. The total time taken was 2 hrs. 5 mins.

The garments were dyed to a turquoise blue shade and were found to be perfectly even, exhibiting a much higher degree of solidity than similar dyed garments produced by the conventional dyeing system. The seams were examined and were found to be perfectly penetrated even in the tightest areas.

ISO 3 Wash Tests were also carried out. The results obtained by the method of the invention with the reactive type dyes showed at least equal fastness to those obtained by the conventional method.

It is a feature of the invention that the dyeing is effected as rapidly as possible in marked contrast to the complexity and great length of the present conventional practice. There are two slight variations of the details of the method of the invention which are as follows:

1. The dyebath to which the goods are to be added is set to a particular pH by the addition of phosphates and a predetermined quantity of Leveller N-R. The goods are pre-treated in the dyebath which has been raised to 100° C for a period of from 10–30 minutes, in particular about 20 minutes and after this pretreatment time, the predissolved dyestuff is added and dyeing is carried out for 20–45 minutes. This leads to a level dyeing, a high degree of penetration and a good appearance which are all achieved in a very short dyeing time. In particular, we find that we can reduce the usual dyeing time of the present conventional practice of around 4 hours by approximately 1 half i.e. to 2 hours. This variation of the dyeing method of the invention is applicable to the dyeing of wool fibres and blends of wool fibres with synthetic polyamide fibres in the form of loose stock or top where the degree of liquor circulation in the types of dyeing machines is typically used in industry for the dyeing of fibres in this form will be very high indeed. This situation also applies to the dyeing of machine-washable woolen garments in what are commercially referred to as "side paddle" machines.

2. A second variation of the method of the invention involves the dyeing of wool or mixtures of wool with synthetic Polyamide fibres where the machinery used is of an insufficient degree of circulation to allow the method described as 1 above to be used. In this second method, the details are as follows:

The substrate wool or wool blend textile material to be dyed is pretreated in the dyebath containing the buffering chemicals and the Leveller N-R at 70 to 20 mins. After this period, the predissolved Reactive dyestuff is added and treatment continued at 70° C for a further 20 mins. The temperature is then raised to 100° C in about 20 minutes and dyeing continued at 100 for a further 20–45 minutes, typically around 30 minutes. This method again leads to a level dyeing exhibiting a high degree of penetration and a good appearance and again is achieved in a comparatively short dyeing time. This method would be applicable to the dyeing of yarn in hanks or on packages and for the dyeing of garments where the structure of the garments was very tightly knitted with very thick seams.

HIGH PRODUCTION OR RAPID DYEING SYSTEM AT 70° C

A small side paddle garment dyeing machine was filled with 180 litres of water at 20° C. Twelve fully fashioned woollen garments having a total weight of 6 kilogrammes which had been previously chlorinated and resin treated to enable them to withstand machine-washing were put into this dyebath. To this dyebath the following were then added:

240 grms Leveller N-R (trade mark of L. B. Holliday)

320 grms Monosodium Hydrogen Phosphate
216 grms Disodium Hydrogen Phosphate previously dissolved in hot water.

The pH of the dyebath after the addition of these agents was found to be 6.5. The temperature of the dyebath and the garments was raised to 70° C and maintained at this temperature for 20 minutes. At the end of this time, 72 grms of Lanasol Blue 3G (trade mark of Ciba-Geigy) and 18 grms of Lanasol Yellow 4G (trade mark of Ciba-Geigy) which had been previously dissolved in hot water were added to the dyebath. Dyeing was continued at 70° C for 20 mins., after which time the temperature was raised over the next 20 minutes to the boil (100° C) and continued at this temperature for a further 20 minutes. After this time, the dyebath was cooled to 80° LC and then run to waste. The machine was refilled with water, the goods were rinsed cold for 15 minutes and the machine was finally emptied and the goods removed and dried.

The garments were dyed to a Turquoise Blue shade and were found to be perfectly even, exhibiting a much higher degree of solidity than similar dyed garments produced by the conventional dyeing system. The garments were examined and were found to be perfectly penetrated even in the tightest areas.

The results obtained in the conventional process and in the two rapid dyeing processes according to the invention at 100° C and 70° C, respectively are shown in Table I below.

TABLE I

| | CONVENTIONAL | | LBH AT 100° C | | LBH AT 70° C | |
|---|---|---|---|---|---|---|
| | Time | Total | Time | Total | Time | Total |
| Fill with water, add chemical, adjust pH | 15 | 15 | 15 | 15 | 15 | 15 |
| Treat goods | 15 | 30 | | | | |
| Add colour | 10 | 40 | | | | |
| Heat to 65° C at 1° C/min | 45 | 85 | | | | |
| Hold 15 mins | 15 | 100 | | | | |
| Examine | 15 | 115 | | | | |
| | | 115 | | 15 | | 15 |
| Raise to 100° C 1° C/min | 35 | 150 | 20 | 35 | | |
| Raise to 70° C | | | | | 20 | 35 |
| Pretreat and add colour (LBH method only) | | | 20 | 55 | 20 | 55 |
| Raise temp to 100° C | | | | | 20 | 75 |
| Maintain at 100° C | 45 | 195 | 45 | 100 | 30 | 105 |
| Cool to 80° C | 10 | 205 | 10 | 110 | 10 | 115 |
| Adjust pH and hold | 20 | 225 | 20 | 130 | 20 | 135 |
| Run liquor to waste | 5 | 230 | 5 | 135 | 5 | 140 |
| Fill | 5 | 235 | 5 | 140 | 5 | 145 |
| Adjust pH | 15 | 250 | 5 | 145 | 5 | 150 |
| Rinse | | | 5 | 150 | 5 | 155 |
| Drain | 5 | 255 | 5 | 155 | 5 | 160 |
| Total | 4 hrs 15 mins | | 2 hrs 35 mins | | 2 hrs 40 min | |

Table II sets out various reactive dyestuffs on the market the reactive groups of which are identified by structural formulae, D being a reference to the remainder of the dyestuff. These may be used successively with the "rapid dyeing" technique of the invention giving improved results at one-half of the total dyeing times now conventially used.

Table III sets out further information regarding major reactive dyes of commerce and Table IV gives details of reactive dyes which are particularly applicable to wools and polyamides.

TABLE II

| Range | DYES Reactive Group | Formula |
|---|---|---|
| Cibacron (CGY) Cibacrolan (CGY) | Monochlorotriazinyl | 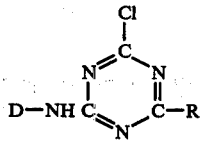 |
| Cibalan Brilliant (CGY) | Chloroacetyl or monochlorotriazinyl | $ClCH_2CONH—D$ |
| Hostalan (FH) | Vinylsulphone-N-methyltaurine | |
| Lanasol (CGY) | α-Bromoacryloylamino | $D—NHCOCB{:}CH_2$ |
| Levafix E (FBy) | Dichloroquinoxaline | |
| Procilan | Acryloylamino | 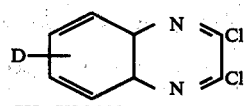 |
| Procion MX (ICI) | Dichlorotriazinyl | $CH_2\ CHCONH—D \div M$ (metal complex) |
| Procion H (ICI) | Monochlorotriazinyl | |
| Reactone (CGY) Drimarene (S) | Trichloropyrimidine | 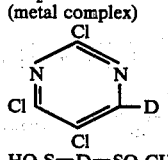 |
| Renazol, Remalon and Remazolan (FH) | Vinylsulphone | $HO_3S—D—SO_2CH_2CH_2OSO_3H$ $HO_3S—D—SO_2CH\ CH_2$ |

TABLE II-continued

| DYES | | |
|---|---|---|
| Range | Reactive Group | Formula |
| Verofix (FBy)<br>Drimalan F (S) | Pyrimidine derivative | 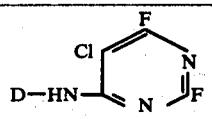 |

TABLE III

| Structure | Commercial Brand Name | Firm | Year of Introduction |
|---|---|---|---|
| 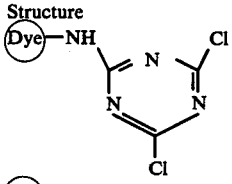 | Procion | ICI | 1956 |
| 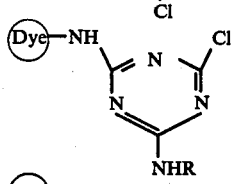 | Procion H<br>Cibacron | ICI<br>CIBA | 1957<br>1957 |
| Dye—$SO_2$—$CH_2$—$CH_2$—O—$SO_3Na$ | Remazol | Hoechst | 1958 |
| 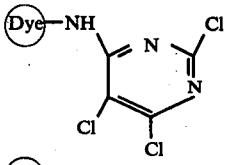 | Reacton<br>Drimaren | Geigy<br>Sandoz | 1959<br>1959 |
| 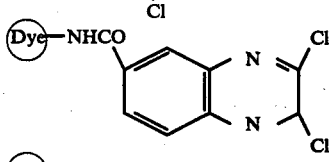 | Levafix E | Bayer | 1961 |
| 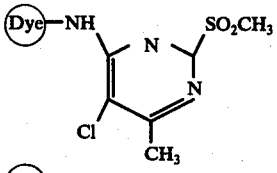 | Levafix E | Bayer | 1966 |
| 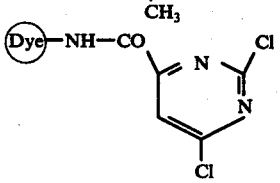 | Reactofil | Geigy | 1968 |
| 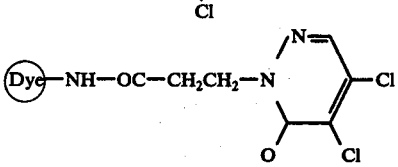 | Primazine P | BASF | 1964 |
| 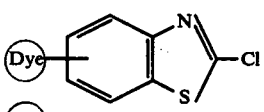 | Elisiane | Francolor | 1963 |
| Dye—$SO_2NHCH_2CH_2OSO_3Na$ | Levafix | Bayer | 1958 |
| Dye—NH—OC—$CH_2CH_2SO_2C_6H_5$ | Solidazol | Casella | 1964 |

TABLE IV

| Major Commercial Types of Reactive Dyes for Wools and Polyamides | | | |
|---|---|---|---|
| Structure | Commercial Brand Name | Firm | Year of Introduction |
| 1:2 Metal complex dye—NH—OC—CH=$CH_2$<br>Dye—NH—OC—CH(Br)—$CH_2Br$ $\xrightarrow{-HBr}$ | Procilan | I.C.I. | 1964 |

TABLE IV-continued

Major Commercial Types of Reactive Dyes for Wools and Polyamides

| Structure | Commercial Brand Name | Firm | Year of Introduction |
|---|---|---|---|
| Dye—NH—OC—C(Br)—$CH_2$ | Lanasol | CIBA | 1966 |
| Dye—NH 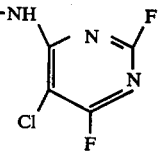 | Verofix<br>Drimalan F | Bayer<br>Sandoz | 1970<br>1970 |

Tables V-1 and V-2 below give specific examples of reactive dichlorotriazinyl and monochlorotriazinyl dyes respectively.

TABLE V-1

EXAMPLES OF REACTIVE DICHLOROTRIAZINYL DYES

| Structure | Shade on Cotton | Commercial name and CT Generic Name | Reference |
|---|---|---|---|
| 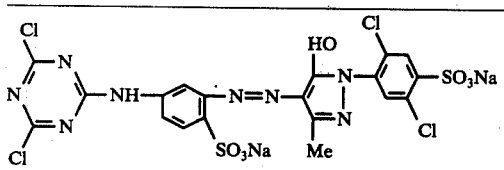 | Bright greenish yellow | Procion Brilliant Yellow M-6G (ICI) CI Reactive Yellow 1 | 4 |
| 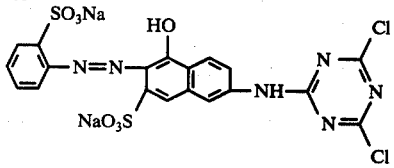 | Bright yellowish orange | Procion Brilliant Orange M-G (ICI) CI Reactive Orange 1 | 5 |
| 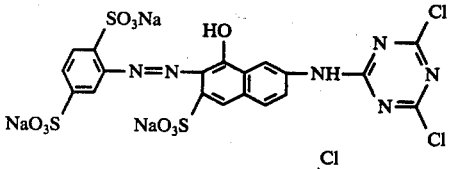 | Bright Scarlet | — | 6 |
| 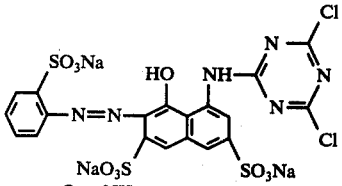 | Bright bluish red | Procion Brilliant Red M-2B (ICI) CI Reactive Red 1 | 7 |
| 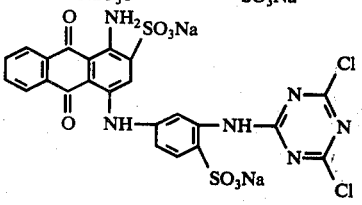 | Bright reddish blue | Procion Brilliant Blue M-R (ICI) CI Reactive Blue 4 | 8 |
| 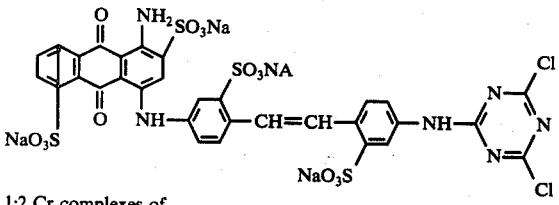 | Bright bluish green | — | 9 |
| 1:2 Cr complexes of 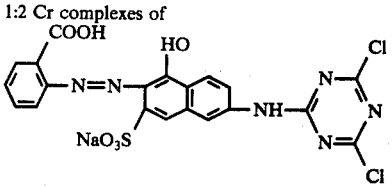 | Brown | — | 10 |

TABLE V-2

EXAMPLES OF REACTIVE MONOCHLOROTRIAZINYL DYES

| | | | |
|---|---|---|---|
| 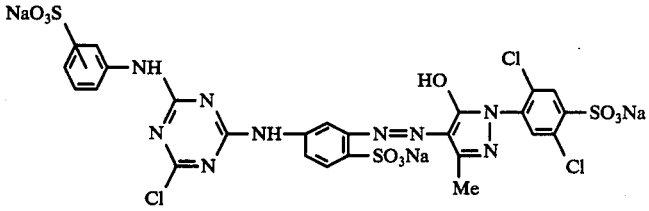 | Bright greenish yellow | Procion Brilliant Yellow H-5G (ICI) Cibacron Brilliant Yellow 3G (CIBA) CI Reactive Yellow 2 | 11 |
| 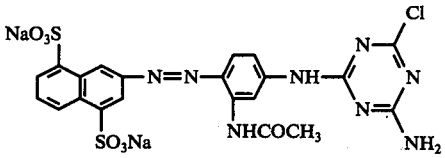 | Bright yellow | Procion Yellow H-A(ICI) Cibacron Yellow R (CIBA) CI Reactive Yellow 3 | 11 |
| 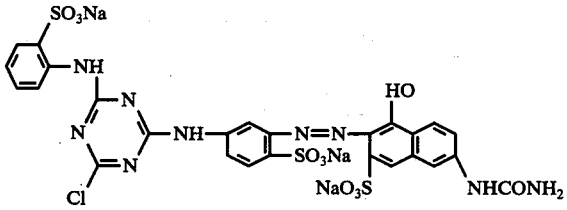 | Bright orange | Procion Brilliant Orange H-GR(ICI) Cibacron Brilliant Orange G (CIBA) CI Reactive Orange 2 | 11 |
| 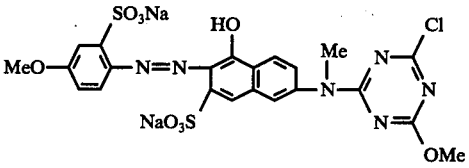 | Scarlet | Procion Scarlet H-R (ICI) Cibacron Scarlet RP (CIBA) CI Reactive Red 13 | 12 |
| 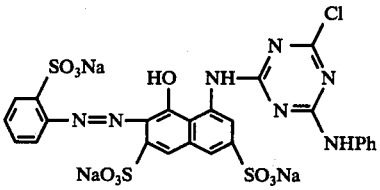 | Bright bluish red | Procion Brilliant Red H-3B(ICI) CI Reactive Red 3 | 4 |
| 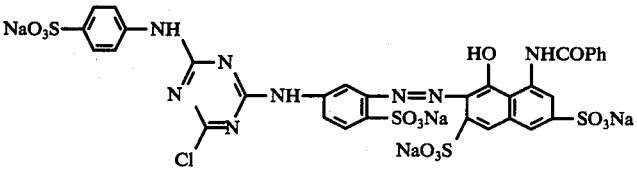 | Bright bluish red | Procion Brilliant Red H-7B(ICI) Cibacron Brilliant Red 3B (CIBA) CI Reactive Red 4 | 11 |
| 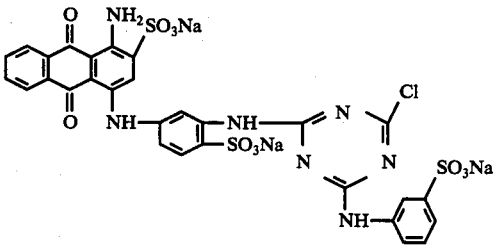 | Bright greenish blue | Cibacron Brilliant Blue BR (CIBA) CI Reactive Blue 5 | 11 |
| Copper phthalocyanine 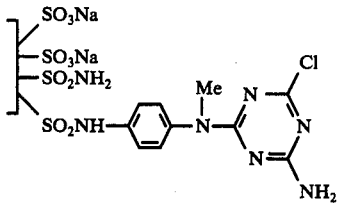 | Greenish blue | — | 13 |

1:2 Cr complexes of

TABLE V-2-continued

| | | | |
|---|---|---|---|
| 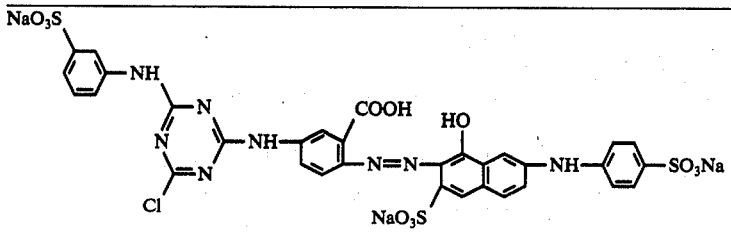 | Dark brown | — | 14 |
| Mixture of 1:2 Cr and Co complexes of 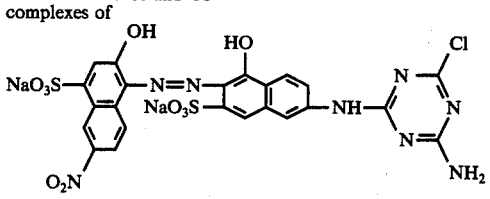 | Black or grey | Procion Black H-G(ICI) Cibacron Black BG (CIBA) CI Reactive Black 1 | 11 |

In connection with Cibalan (Brilliant) dyestuffs, reference is also made to D. Maeusezahl, Textil Veredlung (1970), page 839. Cibacrolan dyes are referred to in Deutsche FarbenKalendar (1959), p.58. Cibacron dyes are referred to in Maeusezahl (loc. cit.), p.839, at page 68 of Deutsche FarbenKalendar and in Venkataraman, "The Chemistry of Synthetic Dyes", Reactive Dyes, Vol. 6, e.g. at pages 2, 130 -1 and 434 (see also the literature references at page 428). The Drimalan F dyes are referred to in J.S.D.C. (1970), p.215 and in Venkataraman (loc. cit. ), at p. 3. The Hostalans are described in the Textile Journal of Australia (1974), page 20 and in "Dyer" 1975 Vol. 154(2) at page 77. The Lanasol dyes are referred to at p.839 of Maeusezahl (loc. cit.), W. Jannsen-Melliand, Textilber (1967), p. 1067 and Venkataraman (loc. cit.), pp. 3 & 9. The Levafix E dyes are referred to inter alia in Maeusezahl (loc. cit.), at pp. 2, 358, 411 and 417 (further literature references being given at p.428). Procialan dyes are referred to in R. Hahn, Textilchemie and Textiltechnikzonderteil der Praktischen Chemie Vol. 16 (2), p.71, J. G. Graham I.C.I. Deutsche Textiltechnik 1966 (16)part 3, page 178, Maeusezahl (loc. cit.) and Venkataraman (loc. cit.), pp. 3, 4, 18 and 130. Remazolan dyes are referred to in Kollodzeiski, J.S.D.C. (1964), page 60, Textile Journal of Australia Vol. 39 (1964), pp. 52, 55 and 93, Kollodzeiski-Melliand, Textilber (1964) Vol. 45., p.51, J.S.D.C. (1964), p.283 and Maeusezahl (loc. cit.), p.839.

We have found that Leveller N-R is particularly suitable with the above mentioned Dyestuffs of the Lanasol, Cibacron, Hostalan, Procilan or Drimalan F types. Leveller N-R is particularly suitable for the application of these dyestuffs on synthetic Polyamide fibres whether of the Nylon 6 or Nylon 6.6 types; on what are commercially referred to as "Machine Washable Wool" fibres and blends of synthetic Polyamide fibres and wool fibres. Machine washable wools are manufactured by the application of a chlorination treatment to the wool either manufactured by the application of a chlorination treatment to the wool either in the top, yarn, or garment state followed by the application of a Polyamide or Polyacrylonitrile resin of which Hercosett (trade mark of Hercules Incorporated) or Dylan GRB or Dylan GRC (trade mark of Precision Processes Textiles Ltd.) are commercially well known examples.

Amongst the auxiliaries which we have successfully tried with the method of the invention are the following:

| | | |
|---|---|---|
| Albegal B | (Ciba Geigy) | Described as an amphoteric polyglycol-ether derivative. |
| Tanapal PA | (Tanatex) | Not described in the Textile Auxiliaries Index. |
| Sandogen NH | (Sandoz) | Described only as a weakly cationic levelling agent for polyamides. |
| Taben ES | Dr. TH. Bohme | Described only as a low-foaming levelling agent for dyeing polyamide giving good coverage of physical irregularities. |
| Dylachem LN 120% | (Precision Processes Textiles Ltd.) | Not described in the literature. |
| Appolene LCF | (DSL Chemicals) | Not described in the literature. |

These are examples of non-ionic, weakly anionic or weakly cationic amphoteric auxiliaries which are presently commercially used in the United Kingdom.

The High Production Dyeing Systen which we have developed not only allows us to apply Reactive dyestuffs to natural and/or synthetic polyamides in one-half the time needed for the treatments previously proposed but also to achieve results which are technically superior.

It is necessary first to understand the treatment applied to wool, for example, to make it machine washable.

APPLICATION OF CHLORINE/RESIN TREATMENTS

These processes have been developed in two ways:

A. As a continuous process in which wool normally in the form of top is fed through a continuous range where it can be chlorinated, resinated, dried to cure the resin and finally washed off and neutralised, or B. As a batch process, which is generally carried out at the garment stage, where the garments are scoured to remove various lubricants and chlorinated, the resin is applied from an aqueous system, curing being affected by pH control as against dry heat curing in the continuous system, and the goods are finally washed off and neutralised ready for dyeing.

Of the two system available, it is much preferred to dye wool from the first method (A), i.e. by the continuous route, since it is generally found that wool treated in this manner is subjected to a significantly lower degree of chlorination than wool treated in a batch system. In the application of Reactive dyestuffs to chlorinated and resin treated wool, the different levels of chlorination treatment do not have a measurable effect on the subsequent wet fastness because of the positive reactive between dyestuff and fibre.

There is no theoretical reason for the difference in processing conditions depending on whether a continuous or batch process is used. The considerations are solely of a practical nature. In the application of chlorine to top material, the wool is presented to the chorination bath in a very open condition and no problem is encountered in chlorinating all the fibres more or less evenly in a very short space of time. On the other hand, in the application of chlorine to spun yarns and garments, it is very evident that this is not the case, particularly in garment form. We have found that, when we come to chlorinate garments where the wool has been spun into a fine yarn, there are differences in stitch density, e.g. between body and rib, and, in order to make a garment, seams are required.

It is probably a consideration of the latter which creates most of the problems in subsequent dyeing. The chlorination of the seam is of vital importance, since if the level of chlorination in the seam is not sufficient to produce the required level of shrink resist, on laundering it may well be found that the body and sleeves show a concertina effect where the seams of the garment shrink and the open material constituting the body does not. In order, therefore, to ensure that the seams are penetrated there is a tendency in many Dyehouses handling garments, to over chlorinate so as to ensure that the garment seam is chlorinated.

The chlorination of wool garments normally takes place at temperatures in the region of 15°-20° C and at pH values in the range of 2-3. Under strongly acid conditions such as these, chlorine is released extremely rapidly from the chlorine compound being used, e.g. sodium hypochlorite. This available chlorine is absorbed equally rapidly by the wool fibre making an even treatment extremely difficult to obtain. Auxiliary products are therefore normally added to the chlorination bath in order to slow down the rate of which chlorine is released. This operation is being carried out at low temperatures. Although wetting agents are used, control of the rate of which chlorine is released is extremely important if a uniform degree of chlorination is to be achieved, particularly in the garment seams. With the subsequent resin application, this has become even more important since the levelness of the resin layer is dependent on the levelness of chlorination. Despite the technical advantages in terms of levelness of application, which the continuous route offers, the predominant practice in the United Kingdom currently is to use the batch route. The reasons advanced for this are twofold:

a. The application of dyestuffs, particularly Reactive types to chlorine/resin treated wool is normally found to be extremely difficult. It is quite easy however in the batch process to dye between chlorination and resination. This is claimed to give the dyer a greater degree of control.

b. Companies prefer to carry stocks of untreated woollen garments, since they can than be diverted to Superwash markets or to others at the last possible time, thereby obviating the need to carry stocks of two types of garment.

The dyeing of wool with Reactive dyestuffs at first proceeds to an equilibrium stage. At this equilibrium stage, the wool fibre has a precise affinity for a given dyestuff under a given set of circumstances and so, we believe, has the resin layer. In the case of the resin layer, however, the affinity is much lower than that of the wool fibre. In other words, at the completion of the dyeing cycle, the resin layer always contains a small amount of dyestuff.

In the case of the Reactive dyestuff, the resin/dyestuff bond is probably due to a reaction between the dyestuff and uncrossed linked amino groups in the resin layer.

We have found as have other workers in this field that machine-washable wools, i.e. chlorine/resin treated wools have an unusually high affinity for dyestuff. This is normally attributed to the strong cationic charge presented by the film of undrawn polyamide type resin on the surface of the fibre. It is this high rate of strike brought about by the cationic charge which gives rise to two main difficulties encountered in the application of dyestuff to Superwash wool, particularly in garment form. These two difficulties apply to:

a. The achievement of a completely solid shade, particularly when using Reactive dyestuffs in binary or tertiary mixtures. This particularly applies to combinations involving a bright yellow and a Phthalocyanine Blue. A skittery appearance is generally obtained which is almost impossible to correct.

b. Seam penetration of garments. Penetration of the seam is, at any time, a problem in garment dyeing. In the case of machine washable wool, it is even more so. The point in the armpit at the junction of four seams is particularly troublesome as is the cuff with its heavy overlocking.

The methods of application in general use up to the present appear to us (see FIG. 1 of the accompanying drawings), to be unnecessarily lengthy and cumbersome. FIG. 1 graphically illustrates the times needed in a conventional method for the different stages. Furthermore, the conventional method does not allow sufficiently for dyeing conditions, viz:

1. at whatever temperature dyestuff is introduced to Superwash wool, the initial strike is extremely rapid;

2. although many reactive dyestuffs are said to behave in a manner of level dyeing Acid dyestuffs at low temperatures (40°-70° C), the cationic charge present on the resin layer does inhibit migration creating problems in achieving level, well penetrated dyeings, and 3. the optimum conditions for the dyeing of woollen materials are those under which the fibre in the form of yarns, garment seams etc., is fully swollen, i.e. at the boil.

The circumstances which satisfy these conditions are those described in our High Production Dyeing System, and can be summarised as follows:

1. Dependent on the shade being dyed, the dyebath is set at an appropriate pH with the auxiliary product e.g. Leveller N-R, and the goods entered.
2. The dye liquor is brought to the boil as rapidly as possible.
3. Boiling is continued for 20 minutes.
4. The predissolved dyestuff is added.
5. Dyeing is continued for 40–45 minutes.
6. The dyebath is cooled and the goods rinsed. This total dye cycle takes approximately 2 hours.

If we now compare this with current dyeing techniques (see FIG. 1), we find as follows:-

1. The dyebath is filled with cold water and the goods pretreated for 15 minutes with auxiliary products. In the United Kingdom during the winter period, the temperature of cold water lies between 6° C–10° C, unless steps are taken to preheat this using waste waters etc.
2. Add dyestuff and treat a further 5 minutes.
3. Raise from cold (10° C) to 70° C at 1° C/minute.
4. Hold for 15 minutes.
5. At this point, many dyehouses remove one garment, dry and examine for levelness seam penetration etc., before continuing. This must add at least 15 minutes to the cycle.
6. Raise to the boil at 1° C/min.
7. Boil 45–60 minutes.
8. Cool to 80° C, add ammonia to ensure removal of all unreacted dyestuff (15 mins)
9. Rinse and scour. We should not expect to complete such a cycle in much less than 4–4½ hrs., compared to the 2–2½ hrs outlined above.

We have determined that the pH conditions required in using our High Production Dyeing System lie within narrow limits. Thus, the pH of the dyebath should lie between 6 and 6.5 and in the majority of cases a pH value 6.25 is satisfactory. In order to ensure that the pH of the dyebath can be maintained, accurately, we have opted for a phosphate buffered system using a mixture of monosodium ortho phosphate and disodium ortho phosphate at a total concentration of 3 g/1.

It is desirable to use a buffered system since, if an acid releasing salt such as ammonium sulphate or ammonium phosphate is used, the pH of the dyebath can never be accurately checked. This is due to the rate at which the wool fibre will absorb the acid being released so that, although the pH of the dyebath might not vary significantly, the internal pH of the wool fibre can drop considerably. The preferred auxiliary product we use in this technique, Leveller N-R, is a low-foaming amphoteric compound. Leveller N-R is used in concentrations of up to 4.0% for pastel shades and from 0.5 - 1.0% for full shades.

The dyebath is set at pH 6.25 with the requisite amount of Leveller N-R depending on the depth of shade being dyed. The goods are entered and the dyebath as brought to the boil as rapidly as possible. The starting temperature is not particularly important and if hot water is available in the dyehouse it should be used. The dyebath is maintained for 15–20 minutes at the boil and the predissolved dyestuff is then added as rapidly as possible. It is desirable that a thorough mix of dyestuff, liquor and goods should be obtained very quickly, since it will be found that around 50% of the dyestuff will be absorbed in the first 10–15 minutes. Dyeing is continued 30–40 minutes after the addition of the dyestuff and, subject to the shade being acceptable, the dyebath is cooled slightly and run off, and the goods are thoroughly rinsed. It has not been found necessary so far to carry out any alkaline treatment to ensure complete reaction of the dyestuff or to remove unreacted dyestuff and time is further saved this way. The complete dyeing operation should not occupy much more than 2 hours.

The dyed goods will be found to exhibit complete seam penetration and a high degree of solidity even in the case of bright Emerald Greens where a mixture of Yellow and Phthalocyanine Blue are involved. The mechanism of dyeing is thought to be that the auxiliary product, e.g. the Leveller N-R produces a temporary partial blocking of the cationic charge on the resin layer allowing a rapid but even exchange of dyestuff molecules as they replace the auxiliary product.

In the dyeing of any substrate, the speed at which dyestuff is absorbed is not particularly important. What is important is how and where the dyestuff is absorbed. In using this technique by having the woollen garment at a completely even pH and fibres swollen to their maximum, we have a system whereby the application of even Reactive dyestuffs becomes a comparatively simple process. The requirements for success are quite straightforward. The amount of Leveller N-R used should desirably balance the amount of dyestuff being applied, since too small an amount of auxiliary product will permit dyestuff to be absorbed unevenly and too great an amount of auxiliary product will prevent satisfactory dyeing by depressing the degree of exhaustion to an unacceptably low level.

Secondly, the introduction of the dyestuff to the dye liquor and through the dye liquor to the fibre interface should preferably be undertaken as rapidly as possible. This can be achieved even in a side paddle machine.

Figure 2:
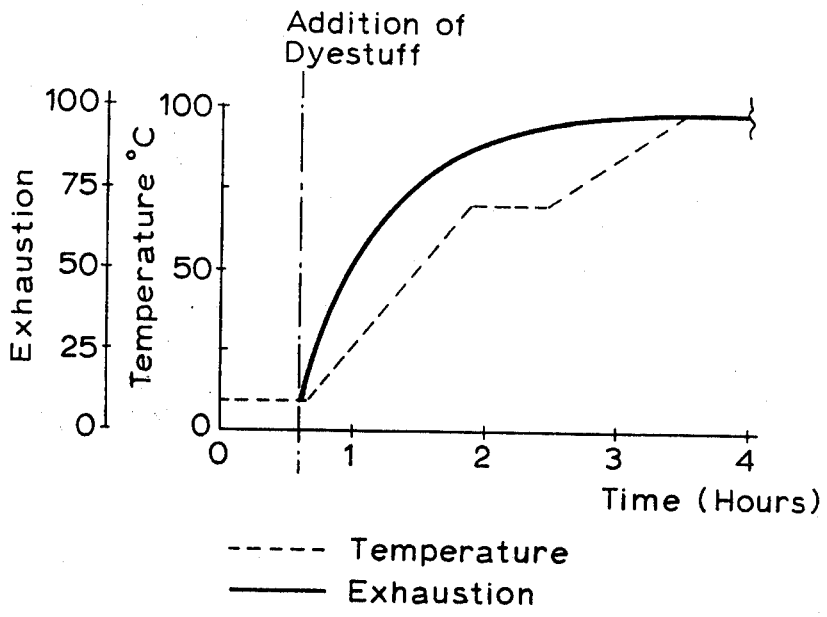
Figure 3:
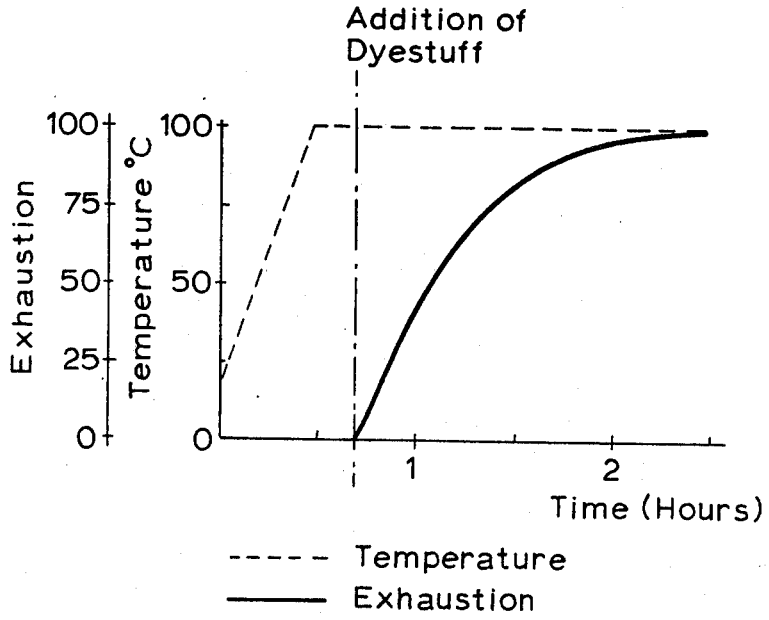
Figure 4A:
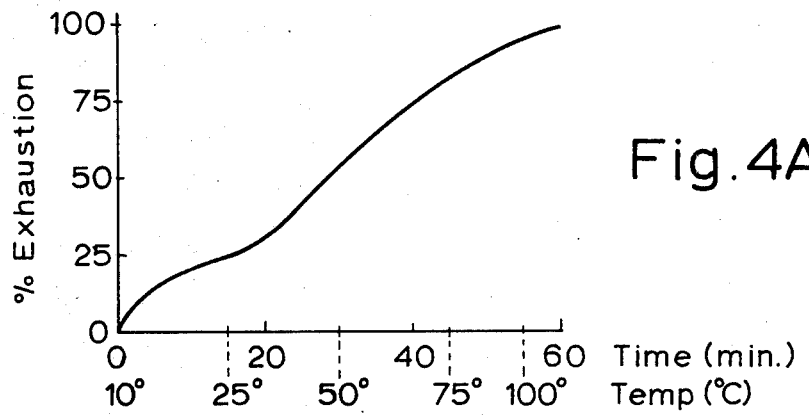
Figure 4B:
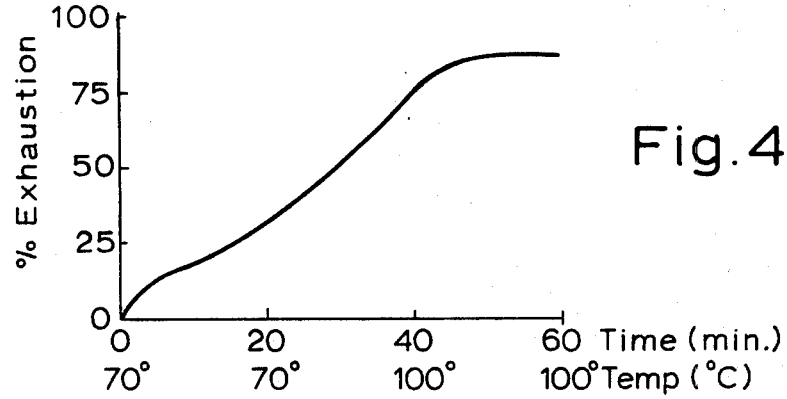
Figure 5A:
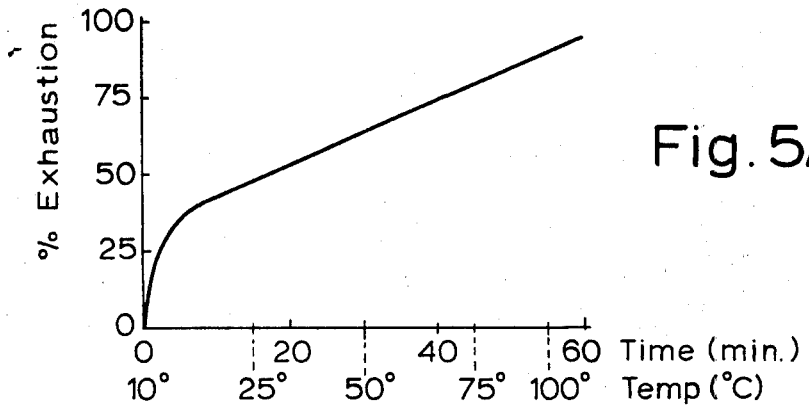
Figure 5B:
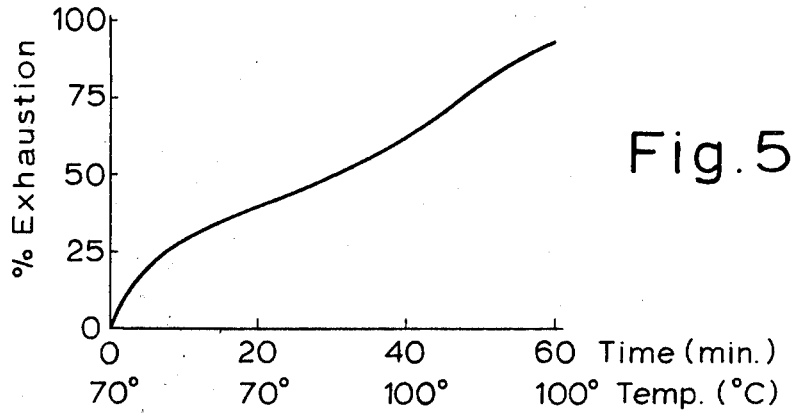
Figure 6A:
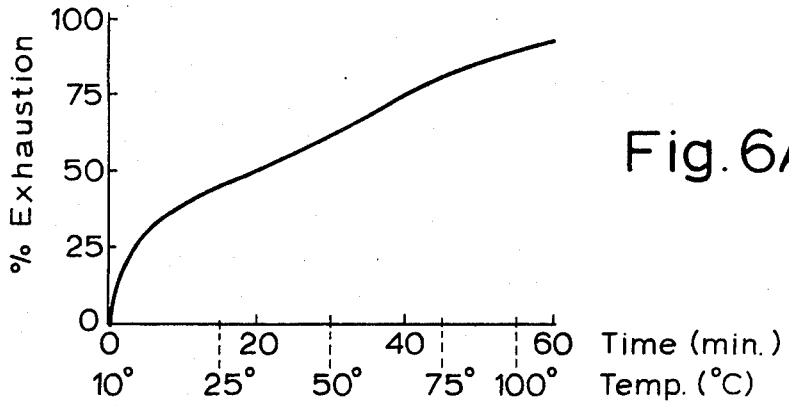
Figure 6B:
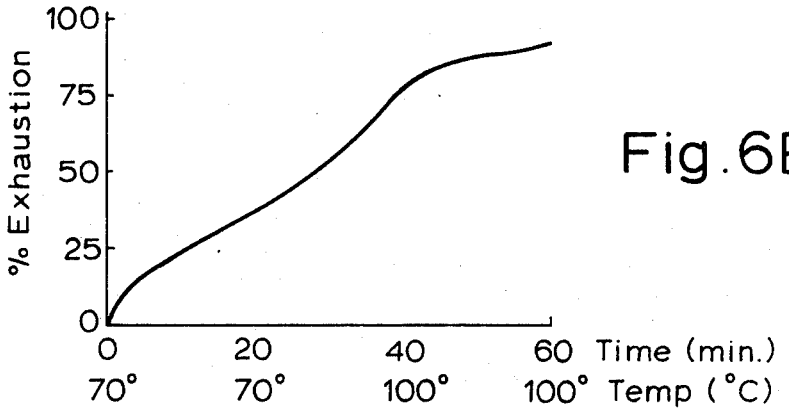
Figure 7A:
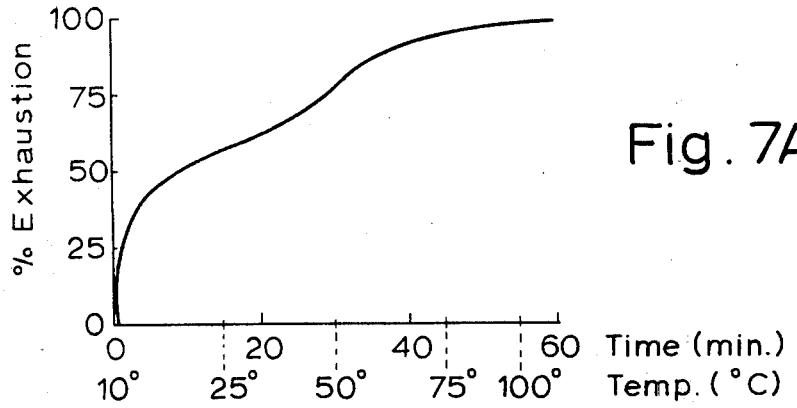
Figure 7B:
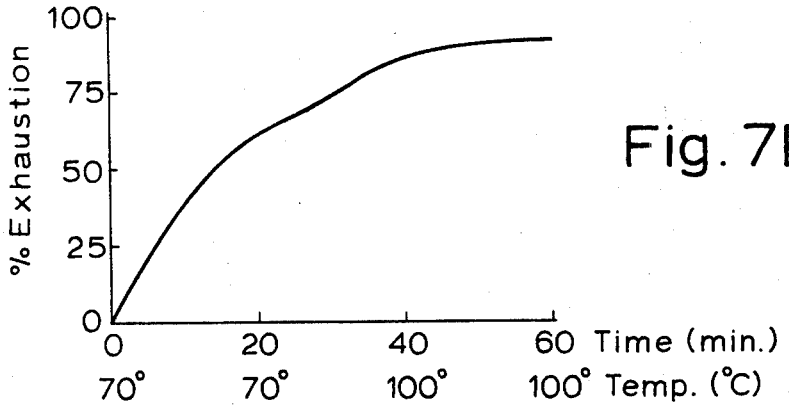
Figure 8A:
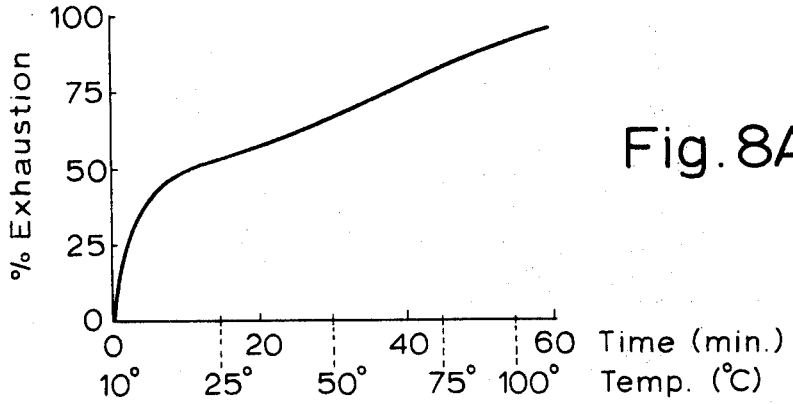
Figure 8B:
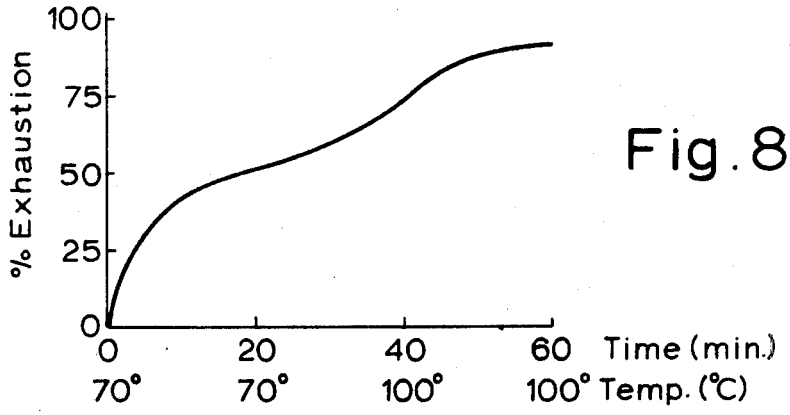
Figure 9A:
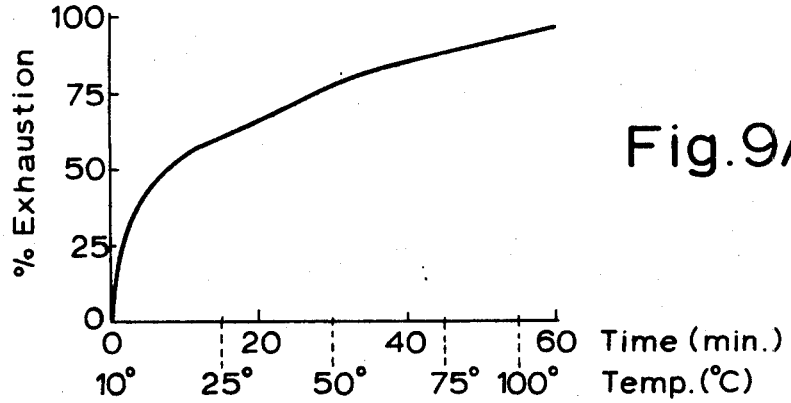
Figure 9B:
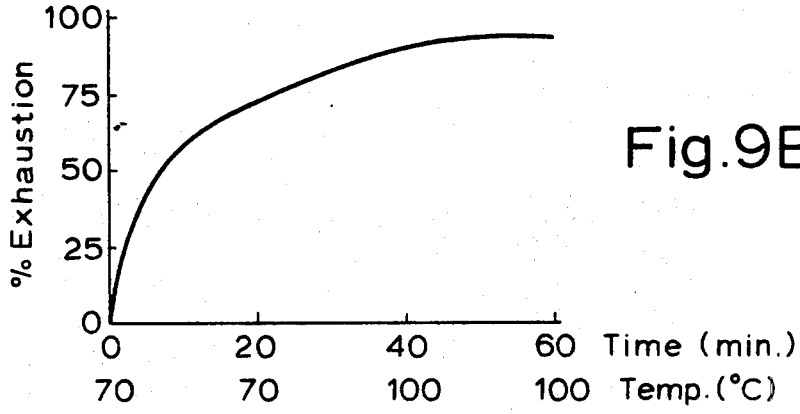

Of the trials which have been carried out, a small trial consisting of a dozen or so garments was carried out in a commercial dyehouse producing a Petrol Blue shade on a regular basis. FIGS. 2 and 3 of the accompanying drawings are graphs showing the exhaustion curves of two dyeings of this Petrol Blue shade carried out in the laboratory. FIG. 2 uses the dyeing method recommended for use with these dyestuffs. FIG. 3 uses our High Production Dyeing System.

We find that the rate of exhaustion using the traditional technique is higher than that using our new technique. What is mot significant about this is that, in the case of our technique, all the dyestuff being absorbed is being absorbed at the boil when the fibres are ideally placed for dyeing. In contrast, by the traditional method, the dyestuff is being absorbed at varying temperatures.

In the trial we then carried out, we used a small side paddle machine where we could achieve a liquor to goods ratio of 30:1. The dyebath was set at around 30°–40° C with 2 g/l monosodium orthophosphate
1 g/l disodium orthophosphate
together with 4.0% Leveller N-R. The pH of the dyebath was chekced and found to be 6.5. The garments were put into the dyebath and the temperature of the dye liquor raised as rapidly as possible to 100° C. The dye liquor was maintained at this temperature for 20 minutes, at the end of which time we added
1.2% of C.I. Reactive Blue 69
0.32% C.I. Reactive Yellow 39

Dyeing was continued a further 40 minutes. The dye liquor was then cooled to around 80° C, run off, and the goods rinsed with cold water. The total time was 2 hrs. 5 mins.

The garments produced were then dried and pressed and compared with garments from previous bulk consignments. It was found that the garments produced on this High Production Dyeing System showed a much higher degree of solidity than was normally obtained and seam penetration was complete.

Although this technique has been particularly described in connection with garment dyeing, the control of the rate of strike and other advantages allowing the production of level, fully penetrated garment seams, have been intended to the dyeing of yarn in hank or package forms.

A further detailed comparison was made between the so-called traditional method of application, and our method with particular reference to pastel shades.

The accepted mechanism of the dyeing of untreated wool with Reactive dyestuffs is as follows:-

At temperatures of up to 70° C under acid conditions, Reactive dyestuffs have an extremely low rate of fixation and can, therefore, be treated more or less as acid levelling dyestuffs in that they will migrate and level freely. Therefore, when these dyestuffs are being applied, a 15–20 minute pause at 70° C ensures complete levelness before the temperature is raised to the boil and fixation takes place. There would not then, appear to be any objection to applying this method to the dyeing of "Hercosett" wool with Reactive dyestuffs, e.g. as indicated in FIG. 1 above.

The material is pretreated for 15 minutes "cold" with an auxiliary product, acid or acid salts etc. As indicated above, the term "cold" is somewhat misleading. It is normally taken to mean "room temperature" which in the U.K. normally means 20° C. In the middle of Winter, cold water in the U.K. can be as low at 5°–6° C and in the middle of a hot summer in a circulating machine, if we take incoming cold water which is at about 20° C and pump it in a machine, the pump heat alone ensures that, even with a fully operational cooling system, the temperature will not drop below 25° C. However, in the conventional system, we start "cold", pretreat for 15 minutes, then add the dyestuff and run a further 5 minutes. The temperature is then raised at 1° C/min to 70° C and maintained at 70° C for 15 minutes to ensure migration takes place and that a completely level result is obtained. The temperature is then raised from 70°–100° C at 1° C/min and maintained at 100° C for 40–60 mins depending upon the depth of shade. The dyebath is then cooled to 80° C, and ammonia is added to ensure complete fixation, and removal of any surface dyestuff. The goods are then rinsed and acidified and finally unloaded.

As indicated above, this process takes somewhere between 3½ hrs and 4½ hrs depending upon the varations possible; e.g., with very pale shades, a temperature of 100° C is not required for complete fixation. This can be achieved at 80°–85° C.

As indicated above, this system is capable of producing commercially acceptable results, but will not produce consistent results over a wide range of shades, e.g. in the dyeing of Emerald green shades using a reactive Phthalocyanine Turquoise together with a Reactive Blue and Yellow, it is almost impossible to produce a dyeing which is completely free from skitteriness. It is also an extremely long process and requires a great deal of control. If additions are to be made, the dyebath must be cooled back to from 75°–80° C and the process rerun from that point. An addition of colour therefore is not likely to take much less than 60 mins.

This process is at its weakest in the application of very pale shades. The application of 4%, 5% or 6% of a dyestuff to any fibre has not proved an enormous problem. The application of 0.5% on the other hand, is always difficult. We now refer particularly to these pastel shades. The conventional process is based on the following assumptions:

1. At low temperatures the rate of absorption of these dyestuffs is slow.

2. At temperatures below 75° C and under acid conditions, the rate of fixation is extremely low, therefore migration and levelling take place. We have examined the following six dyestuffs:-

| | |
|---|---|
| Lanasol Yellow 4G | C.I. Reactive Yellow 39 |
| Lanasol Orange R | C.I. Reactive Orange 29 |
| Lanasol Red 6G | C.I. Reactive Red 84 |
| Lanasol Red 5B | C.I. Reactive Red 66 |
| Lanasol Blue 3G | C.I. Reactive Blue 69 |
| Lanasol Blue 3R | C.I. Reactive Blue 60 |

in an attempt to produce evidence which would support or disprove these assumptions. In all cases, the depth of dyestuff used was 0.5% on the weight of material.

The temperature was kept at 70° C, since this is the point at which, in the traditional dyeing system, 15–20 minutes are normally allowed to permit migration and levelling. We took our samples after 10 minutes at 70° C to ensure that stabilisation at this temperature was complete.

The dyebath was set cold using auxiliary products recommended by the manufacturer, raised to 70° C at 1° C/min and maintained at 70° C for 10 minutes. At this point, half of the fabric was removed and replaced by an equal amount of white fabric. Dyeing was then carried on for a further 50 minutes, making a total of 60 minutes at 70° C. There are two things which these examples show quite clearly. Firstly, we can see that, after 10 minutes at 70° C, a high degree of exhaustion had been achieved, the average being substantially 70–80%. If a significant degree of migration to be promoted, this figure would not be particularly significant, but can be seen from the examples below, no true migration took place. All that happened was that the sample of white material added to the dyebath as the first sample was removed had absorbed whatever colour was left in the dyebath.

The sample which was removed after 10 minutes at 70° C and the sample which was left in for the whole 60 minutes cycle were both extracted to determine the degree of fixation, the results being shown in Table V below.

TABLE V

| | 10 Mins 70° C | | 60 Mins 70° C | |
|---|---|---|---|---|
| | Exhaustion | Fixation | Exhaustion | Fixation |
| Lanasol Yellow 4G | 65% | 75% | 100% | 90% |
| Lanasol Orange R | 70% | 40% | 100% | 90% |
| Lanasol Red 6G | 70% | 50% | 100% | 90% |
| Lanasol Red 5B | 85% | 70% | 100% | 95% |
| Lanasol Blue 3R | 75% | 50% | 100% | 75% |
| Lanasol Blue 3G | 83% | 50% | 100% | 90% |

At 70° C, exhaustion was preceeding at a high rate, fixation was occurring at a much more rapid rate than has been suggested, and migration would appear to be nil. Furthermore, after 15 minutes at 70° C., the temperature still had to be raised at only 1°/min followed by boiling to promote fixation.

By the time the dyebath temperature had reached 70° C and had been maintained at that value for 10 minutes, exhaustion was in the region of 70–80% and fixation of the dyestuff was in the region of 50–60%. The migration of the remaining 40–50% was nil. The reason for this phenomenon is quite simple and has been known by most workers in this field from the beginning, but it seems the significance has not been fully appreciated.

When the wool fibre is coated with a layer of undrawn polyamide resin, it is left with an abnormally high cationic charge. Wool of course, and for that matter polyamide fibres, absorb dyestuff and dye, because they themselves contain a slight cationic charge which will attract the anionic particles of the acid dyestuff. Unfortunately, in the case of the resin layer, the cationic charge is high enough to cause not only an electrostatic attraction but an electrostatic bond. In practice the dyestuff is precipitated on the resin layer. As the temperature increases, this dyestuff will diffuse through the resin layer into the wool where it will then form its normal covalent link as it reacts, but this cationic charge is high enough to ensure that the absorption of dyestuff is very rapid and that the retention of dyestuff in its unfixed condition is extremely high. We have then a situation where dyeing is being carried out under the worst possible conditions. That is, dyestuff is being absorbed at very low temperatures when the wool fibre is only slightly swollen. The uptake is not particularly even and migration will be minimal.

From the work we have done, we know that, whatever set of dyeing conditions we pick for shades of this depth, the rate of exhaustion will be extremely high irrespective of temperature, pH etc. Our dyeing system has been devised to ensure that these dyestuffs are being absorbed in the right place and at the right time.

Wool is in an ideal condition for dyeing when it is in a boiling dyebath since:

a. the fibres are completely swollen, permitting movement of dyestuff particles;
b. the pH of the material can be completely equalised; and
c. the dyestuff solution is at its best.

In the case of polyamides such as wools and nylons and reactive dyestuffs, the addition of the dyestuff at the boil is not a practical proposition unless some steps are taken to minimise the initial abnormally high rate of strike. This is done by using an amphoteric auxiliary such as Leveller N-R. By using a product of this type, i.e. a product which, although basically nonionic has slight anionic properties, we can partially neutralise the cationic charge on the resin layer long enough to permit a more even uptake of dyestuff than would normally occur. The only limiting factor in a dyeing system such as this is the speed and efficiency of the dye liquor circulation. We have found in bulk work that the addition of dyestuff to a boiling dyebath is not possible in all cases. We have therefore, two variations on this particular theme. These are referred to as:

a. THE HIGH PRODUCTION DYEING SYSTEM

In this dyeing system, the material to be dyed is pretreated for 20 minutes at the correct pH with the appropriate amount of Leveller N-R at 70° C. The dyestuff is added and the bath is maintained a further 20 minutes at 70° C. The dye liquor is then heated to the boil in 20 mins and boiling continued a further 20–40 minutes depending upon the depth of shade. This technique is that normally recommended for the dyeing of yarn in hank or package form.

b. THE ULTRA HIGH PRODUCTION DYEING SYSTEM

In this dyeing system, the material is pretreated 20 minutes at 100° C at the correct pH with the appropriate amount of Leveller N-R. The dyestuff is then added at the boil and boiling continued 20–40 minutes depending upon the depth of shade. This system is the one normally adopted when dyeing loose wool, top or garments.

For the six dyestuffs under examination, we have produced a dyeing curve with wool for:

a. The Traditional Dyeing System; and
b. The High Production Dyeing System.

As can be seen the graphs produced are very close together. There are two significant points which can be drawn from these graphs. (FIGS. 4 to 9 of the drawings).

1. The rate of exhaustion i.e. the speed of dyeing is virtually the same for both dyeing systems.
2. More important, the dyestuff which is being absorbed on a traditional dyeing route is being absorbed from cold onwards, whereas the dyestuff in our system is being absorbed by wool which is in a much better condition to receive dyestuff.

We now turn to consider migration using the same test as used for the traditional dyeing system, i.e. the dyebath is prepared at 70° C, the material is pretreated, and the dyestuff is added. After 10 minutes, half the material is removed and replaced with white material and dyeing is continued for 50 minutes, to indicate whether or not any migration is occurring. We find that, although we have slowed down the rate of exhaustion at this temperature and the fixation at this temperature, there is no great improvement in the degree of migration. The exhaustion and fixation figures for this dyeing system are shown in Table VI below where, as can be seen, the exhaustion after ten minutes at 70° C, i.e. 10 minutes after the dyestuff has been added is in the region of 40% and fixation occurs at about the same rate. We find that, when we consider 60 minutes at 70° C by this system, fixation is lower than it would be in a normal dyeing system, but this is overcome as the dyebath is raised to the boil.

TABLE VI

| | 10 Mins 70° C | | 60 Mins 70° C | |
|---|---|---|---|---|
| | Exhaustion | Fixation | Exhaustion | Fixation |
| Lanasol Yellow 4G | 35% | 40% | 100% | 75% |
| Lanasol Orange R | 30% | 50% | 100% | 85% |
| Lanasol Red 6G | 25% | 25% | 100% | 50% |
| Lanasol Red 5B | 40% | 40% | 100% | 75% |
| Lanasol Blue 3R | 60% | 35% | 100% | 85% |
| Lanasol Blue 3G | 45% | 25% | 100% | 75% |

We have shown that, at whatever temperature, the Reactive dyestuff is added to a dyebath containing Hercosett treated materials, the rate of exhaustion is very high. The rate of fixation at comparatively low temperature is also much higher than one would normally expect and, because of the electrostatic bonding which occurs at the dyestuff and fibre interface, migration does not occur to any significant degree.

We have also shown that it is possible to add dyestuff at 70° C without significantly increasing the rate of exhaustion, providing a system such as ours is used.

We have therefore arrived at a point where we have a simple and effective dyeing system. All that the user of this system is required to do is to firstly to establish which process is suitable for use in his particular set of conditions and then to establish for example, the Leveller N-R:pH value ratio. In general terms, the conditions required can be stated quite simply and are included herein in Table VII below:

TABLE VII

| DYESTUFF | LEVELLER N-R | pH |
|---|---|---|
| Up to 1.0% | 4.0% | 6.5 |
| 1.0 - 1.5% | 3.0% | 6.5 |
| 1.5% - 2.5% | 3.0% | 6 |
| 2.5% - 4.5% | 2.0% | 6 |
| Over 4.5% | 1.0% | 1.0% - 2.0% Acetic Acid |

| Phosphate Buffer Systems | |
|---|---|
| Total concentration 3 g/l | |
| 100 parts Monosodium dihydrogen phosphate | = pH 5 |
| 80/20 Monosodium dihydrogen/sodium dihydrogen phosphate | = pH 6.5 |
| 95/5 Monosodium dihydrogen/sodium dihydrogen phosphate | = pH 6 |

These ratios may vary depending on the quality of the phosphate powders etc available, but can be easily checked by prior tests.

In practice, the conditions should be arranged so that in the dyeing of pastel to medium depth shades a small amount of dyestuff is left in the dye liquor say, 5–8%, thus ensuring that dyeing equilibrium has been established. Therefore, in laboratory work to establish conditions in a particular dyehouse, if 100% exhaustion is being reached very quickly in these pastel shades, either the pH value should be altered or the amount of Leveller N-R increased. There is however no point in increasing the amount of Leveller N-R over the top limit of 4.0%. Beyond this point, additional quantities do not have any effect.

It is important that a buffered pH system should be used. It is surprisingly difficult to gain an accurate measurement of pH during the dyeing of wool. All that is normally checked in the Dyehouse is the pH value of the dyebath. This is not necessarily the same as the pH of the wool fibre. The classic example of this is the use of salts such as ammonium sulphate in the dyeing of wool. If a dyebath is set with ammonium sulphate and the dye liquor checked, the pH value will be found to be around the neutral point. If wool is dyed in this dyebath at the boil and the pH value is checked again, the pH value will have dropped, but not by a very large amount, particularly when we consider we are releasing sulphuric acid into the dyebath.

The reason for this is quite simple. The wool fibre will absorb the sulphuric acid being liberated as quickly as it is produced, thus producing a significant difference between the pH of the dyebath and the internal pH of the wool fibre which is where the dyeing takes place. This can be quite easily established by preparing two dyebaths with ammonium sulphate and placing a piece of wool in one and a piece of nylon in the other and boiling both baths for 60 minutes and checking the pH values before and after drying.

If we therefore have a dyebath in which the pH fluctuates, we also have a dyebath in which the absorption and final exhaustion of dyestuff will fluctuate and, since this fluctuation is not constant, the results produced will not be constant. For example, should the pH of the dyebath drop in the early stages of dyeing, the rate of exhaustion would be increased, and therefore the possibility of non-level results would be increased. Conversely, should the pH of the dyebath drift upwards towards the end of the dyeing cycle, the degree of exhaustion would drop.

One of the benefits of our dyeing system is that dyeing always proceeds to equilibrium, therefore ensuring a very high degree of reproducibility. This is particularly important in the case of Reactive dyestuffs since it is preferred not to make additions which, apart from anything else, extend the dye cycle. However, on those occasions when additions have been required, we have made small additions of dyestuff at the boil complete success.

In conclusion, the reasons advanced in support of the traditional method of application have been based on past experience in applying fast dyestuffs whether or not they were Reactive to untreated woollen materials. The observations on which these arguments were based were as follows:-

1. The absorption of fast dyestuffs by wool at low temperatures is comparatively slow.
2. At temperatures below 75° C and under acid conditions, Reactive dyestuffs have an extremely slow rate of fixation and can therefore migrate in the manner of acid dyestuffs.

It has, therefore, always seemed reasonable to apply these arguments when applying reactive dyestuffs to machine washable wool. Unfortunately, these arguments are not valid, since:

1. The absorption of reactive dyestuffs by machine washable wool is extremely high, irrespective of temperature; and
2. The rate of fixation of reactive dyestuffs on machine-washable wool is extremely high, even at temperatures as low as 70° C.

What in fact happens when reactive dyestuffs are added at low temperatures to a dyebath containing machine washable wool is that:

a. the initial rate of strike is extremely high, irrespective of the conditions used;
b. the amount of migration is negligible; and
c. the rate of fixation is very high, even at temperatures as low as 70° C.

The dyeing therefore takes place as stated above under the worst possible conditions, i.e. when the wool fibre is still in a partially swollen state and, because of its previous pretreatment, is not at an even pH, and further the dyestuff solution is in its poorest condition.

In contrast, as we have proved in bulk trials, it is possible to introduce Reactive dyestuffs to a boiling dye liquor containing machine washable wool and to produce solid, level, well penetrated results. The degree of success relies on the mechanics of the dyeing system, i.e. on how quickly and how thoroughly circulation can be maintained. To allow for this, we have developed as stated above two variations:

A. The High Production Dyeing System; and
B. The Ultra High Production Dyeing System

HIGH PRODUCTION DYEING SYSTEM

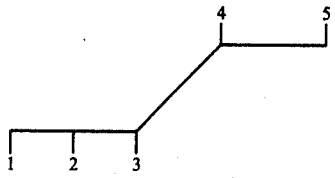

1. Set dyebath with phosphate buffer and Leveller N-R at 70° C. Enter material, treat 20 minutes.
2. Add dyestuff, maintain at 70° for 20 minutes.
3. Raise to 100° C in 20 minutes.
4. Dye at 100° C for 20–60 minutes depending on the depth of shade.
5. Cool and finish as normal.

The determination of the correct balance between pH value and amphoteric auxiliary must be determined in the laboratory before bulk dyeing commences. Reproducibility is of a very high order.

ULTRA HIGH PRODUCTION DYEING SYSTEM

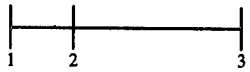

1. Set dyebath with phosphate buffer and Leveller N-R at 100° C, enter material, treat for 20 minutes at 100° C.
2. Add dyestuff, maintain at 100° C for 20–60 minutes depending upon depth of shade.
3. Cool and finish in normal manner.

As before, the correct balance between Leveller N-R and pH value must be established in the laboratory before bulk dyeing commences and here again, once these conditions have been established, the degree of reproducibility is extremely high.

The required ratios of dyestuff: Leveller N-R: pH value can be established by taking the following figures as a guide.

| Dyestuff | Leveller N-R | pH |
|---|---|---|
| Up to 1.0% | 4.0% | 6.5 |
| 1.0% - 1.5% | 3.0% | 6.5 |
| 1.5% - 2.5% | 3.0% | 6 |
| 2.5% - 4.5% | 2.0% | 6 |
| Over 4.5% | 1.0% | 1.0% - 2.0% Acetic Acid |

pH Values

In a dyeing system such as this, where a careful balance must be maintained, a buffered system is used to maintain the correct pH value. The system we have adopted is that of using two phosphate as follows:-

PHOSPHATE BUFFER SYSTEMS

| Total concentration 3 g/l | |
|---|---|
| 100 parts Monosodium dihydrogen phosphate | = pH 5 |
| 80/20 Monosodium dihydrogen/ sodium dihydrogen phosphate | = pH 6.5 |
| 95/5 Monosodium dihydrogen/ sodium dihydrogen phosphate | = pH 6 |

These ratios may vary depending on the quality of the phosphate powders etc available, but can be easily checked in the laboratory.

The invention is further illustrated by the following specific examples.

EXAMPLE 1

6,000 ml water were adjusted to give a pH value of 6.5 by the addition of:

10.8 g sodium dihydrogen orthophosphate; and
7.2 g disodium hydrogen orthophosphate
5.0 g Leveller N-R (trade mark of L. B. Holliday & Co. Limited. Huddersfield, England) were added to the dyebath which was then heated to a temperature of 40° C.

A woollen garment weighing 200 grms, which had previously been subjected to a chlorination/resin treatment to enable it to withstand mechanical washing processes, was put into the dyebath and the temperature was raised in 15 minutes to 100° C. The temperature was maintained for 15 minutes at 100° C and 4.0 grms of Lanasol Red 4G (trade mark of Ciba-Geigy) which had been previously dissolved were added to this dyebath. Treatment was continued at 100° C for a further 45 minutes with agitation of the material being dyed. The woollen garment was then removed from the dyebath, rinsed thoroughly with cold water and dried.

On examination, it was found to be dyed to a scarlet shade and exhibited a perfectly level and solid appearance. On examination, the seams in the garment were found to be completely penetrated.

EXAMPLE 2

6,000 ml water were adjusted to a pH value of 6.5 by the addition of:

10.8 g sodium dihydrogen orthophosphate; and
7.2 g disodium hydrogen orthophosphate.
5.0 g of Leveller N-R (trade mark of L. B. Holliday & Co. Limited. Huddersfield, England) were added to the dyebath which was then heated to a temperature of 40° C.

A woollen garment weighing 200 grms, which had previously been treated by a chlorination/resin treatment to enable it to withstand mechanical washing processes, was put into the dyebath, and the temperature was raised in 15 minutes to 100° C. The temperature was maintained for 15 minutes at 100° C and 2.5g Cibacron Pront Turquoise G (trade mark of Ciba-Geigy) and 2.5 g Lanasol Yellow 4G (trade mark of Ciba-Geigy), which had been previously dissolved were added to this dyebath. Treatment was continued at 100° C for a further 45 minutes with agitation of the material being dyed. The woollen garment was then removed from the dyebath, rinsed thoroughly with cold water and dried.

On examination, it was found to be dyed to an emerald green shade and exhibited a perfectly level and solid appearance. On examination, the seams in the garment were found to be completely penetrated.

We should mention that our method allows the above dyestuff to be commercially used with success in contrast to the difficulties encountered with conventional techniques.

EXAMPLE 3

6,000 ml water were adjusted to give a pH value of 6.5 by the addition of:

10.8 g sodium dihydrogen orthophosphate; and
7.2 g disodium hydrogen orthophosphate.
6.0g Leveller N-R (trade mark of L. B. Holliday & Co. Limited of Huddersfield, England) were then added to the dyebath which was then heated to a temperature of 40° C.

A woollen garment weighing 200g, which had previously been treated by a chlorination/resin treatment to enable it to withstand mechanical washing process, was put into the dyebath and the temperature was raised in 15 minutes to 100° C.

The temperature was maintained for 15 minutes at 100° C and 3.0 g Lanasol Red 4G (trade mark of Ciba-Geigy); and 0.6 g Lanasol Red 5B (trade mark of Ciba-Geigy) which had been previously dissolved were added to this dyebath.

Treatment was continued at 100° C for a further 45 minutes with agitation of the material being dyed. The woollen garment was then removed from the dyebath, rinsed thoroughly with cold water and dried. On examination, it was found to be dyed to a bright Red shade and exhibited a perfectly level and solid appearance. The seams in the garment were found to be completely penetrated.

EXAMPLE 4

6,000 ml water were adjusted to give a pH value of 6.5 by the addition of:

10.8 g sodium dihydrogen orthophosphate; and 7.2 g disodium hydrogen orthophosphate.

8.0 g Leveller N-R were added to the dyebath which was then heated to a temperature of 40° C.

A woollen garment weighing 200 g, which had previously been treated by a chlorination/resin treatment to enable it to withstand mechanical washing processes, was put into the dyebath and the temperature was raised in 15 minutes to 100° C. The temperature was maintained for 15 minutes at 100° C and 3.2 g Lanasol Blue 3G (trade mark of Ciba-Geigy); and 0.6 g Lanasol Yellow 4G (trade mark of Ciba-Geigy), which had previously been dissolved, were added to this dyebath. Treatment was continued at 100° C for a further 45 minutes with agitation of the material being dyed. The woollen garment was then removed from the dyebath, rinsed thoroughly with cold water an dried. On examination, it was found to be dyed to a bright blue/green shade and exhibited a perfectly level and solid appearance. The seams in the garment were found to be completely penetrated.

EXAMPLE 5

6,000 ml water were adjusted to give a pH value of 5.75 by the addition of:

16.2 g sodium dihydrogen orthophosphate; and 1.8 disodium hydrogen orthophosphate.

2.0 g Leveller N-R (trade mark of L. B. Holliday) were added to the dyebath which was then heated to a temperature of 40° C.

A woollen garment weighing 200 g, which had previously been treated by a chlorination/resin treatment to enable it to withstand mechanical washing processes, was put into the dyebath and the temperature was raised in 15 minutes to 100° C. The temperature was maintained for 15 minutes at 100° C and 6.0 g Lanasol Yellow 4G (Ciba-Geigy trade mark):

2.0 g Lanasol Red 5B (Ciba-Geigy trade mark):

2.0 g Lanasol Blue 3R (Ciba-Geigy trade mark), which had been previously dissolved, were added to this dyebath. Treatment was continued at 100° C for a further 45 minutes with agitation of the material being dyed.

The woollen garment was then removed from the dyebath, rinsed thoroughly with cold water and dried. On examination, it was found to be dyed to a brown shade and exhibited a perfectly level and solid appearance. The seams in the garment were found to be completely penetrated.

EXAMPLE 6

2,730 liters of water in a Pegg side paddle garment dyeing machine, Type PD 5292 were adjusted to give a pH value of 6.0 by the addition of 8.0 kilos of Monosodium Dihydrogen Phosphate 1.5 kilos of Disodium Hydrogen Phosphate 2.5 kilos of Leveller N-R (trade mark of L. B. Holliday)

Woollen garments weighing in all 83 kilos which had previously been treated by a chlorination resin treatment to enable them to withstand mechanical washing process and which had also been subjected to a prescouring process with a non-ionic detergent were put into this buffered dyebath and the temperature was maintained at 70° C for 20 minutes. After this time, 1,050 kilos of Lanasol Red G (Ciba Geigy trade mark) 0.921 kilos of Lanasol Orange R (Ciba Geigy trade mark) 22 grms of Procilan Red B2B (ICI trade mark) which had previously been dissolved were added. Treatment was continued at 70° C for 20 minutes. The temperature was then raised to 100° C over a period of 20 minutes and maintained at 100 for a further 30 minutes. At the end of this time, the woollen garments were rinsed, dried and found to be dyed to a Scarlet shade and to be of a perfectly level and solid appearance. The seams in all the garments were found to be completely satisfactorily penetrated.

EXAMPLE 7

2,800 liters of water in a Freeman Taylor Grid Flow side paddle dyeing machine were adjusted by the addition of 8 kilos of Monosodium Dihydrogen Phosphate and 1½ kilos of Disodium Hydrogen Phosphate to give a pH of 6.0 2.5 kilos of Leveller N-R (trade mark of L. B. Holliday) were added to this dyebath which was then heated to a temperature of 70° C. Woollen garments weighing 82 kilos which had previously been treated by a chlorination resin treatment to enable them to withstand mechanical washing, were put into the dyebath and the temperature was maintained at the buffered pH of 6 and at 70° C for 20 minutes. After this time

| | |
|---|---|
| 2.46 kgs Drimalan Blue F2GL<br>0.41 kgs Drimalan Red F2GL<br>0.49 kgd Drimalan Red F2BL<br>0.21 kgs Drimalan Red F3GL | (Trade Mark of SANDOZ) |

which had previously been dissolved in hot water were added to this dyebath. Treatment was continued at 70° C for a further 20 minutes, after which time the temperature was raised over a further period of 20 mins to 100° C. Treatment was continued at 100° C for 30 minutes when the garments were removed from the dyebath rinsed thoroughly with cold water and dried. On examination, the garments were found to be dyed to a Navy Blue shade and exhibited a perfectly level and solid appearance. The seams of the garments were found to be completely satisfactorily penetrated.

EXAMPLE 8

1,000 liters of water in a Henriksen package dyeing machine were adjusted to give a pH of 6 by the addition of 2.4 kgs of Monosodium Dihydrogen Phosphate and 0.60 kg of Disodium Hydrogen Phosphate 3.4 kgs of Leveller N-R (trademark L. B. Holliday) were added to this dyebath. The dyebath was then brought into contact in the Henricksen machine with 114 kgs of wool machine knitted yarn wound on rocket packages on the normal holders for this machine. The wool fibre from which this yarn had been spun had been subjected before spinning to a chlorination and resin treatment process in order that the garments which were subsequently knitted from the dyed yarn should be capable of withstanding several machine washing cycles. The yarn was treated in the pH buffered dyebath for 20 minutes at 70° C at which point 0.547 kgs of Lanasol Yellow 4G (Ciba Geigy trade mark)

0.413 kgs of Lanasol Red 6G (Ciba Geigy trade mark)

0.274 kgs of Lanasol Blue 3G (Ciba Geigy trade mark) which had been previously dissolved in hot water were added to the dyebath. The dyebath was then maintained at 70° C for a further 20 minutes, after which period, the temperature was raised to 100° C over about 20 minutes, and subsequently maintained at 100° C for a further 20 minutes. At this point, the yarn was examined and found to be dyed to a fawn shade and to be dyed in a completely level and penetrated manner. This penetration and levelness was subsequently confirmed when the yarn from the inside and outside of a sample package were knitted and examined.

EXAMPLE 9

Approximately 2,950 liters of water in a Longclose pearshaped loose stock dyeing machine were brought to the boil with the addition of 7.5 krs of Leveller N-R (the trade mark of L. B. Holliday) and 6 liters of 80% Acetic Acid. 200 kilos of carpet quality wool fibre, plus 50 kilos of Lilion synthetic polyamide fabric were introduced into this dyebath in the normal fibre holder for this type of machine and pretreated in this dyebath for 20 minutes at the boil. After this pretreatment 12.5 kg. Lanasol Orange G 0.5 kg. Lanasol Red 6G 25 g. Lanasol Blue 3G which had previously been dissolved in the side tank of the machine in hot water were introduced rapidly into the machine whilst it was boiling. Dyeing was continued at the boil for 45 minutes.

The shade of the wool and nylon fibre was examined and found to be as required. The dyebath was run away to waste and the fibres were rinsed in a normal manner. Upon examination, the wool and nylon fibres were found to be dyed to the required colour and in a completely acceptable manner.

EXAMPLE 10

Approximately 2,950 liters of water containing 5 kg. of Leveller N-R (trade mark of L. B. Holliday) plus 6 liters of 80% Acetic Acid were brought to the boil. 200 kg. of carpet quality wool fibre and 50 kg. of Lilion synthetic polyamide fabric were introduced into this liquor in the normal holder for the machine which was a Longclose pear-shaped loose stock dyeing machine. The wool and polyamide fibre was pretreated in this boiling dye liquor for 12 mins, after which time

| | |
|---|---|
| 12.5 kg. Lanasol Orange G | |
| 0.5 kg. Lanasol Red 6G | (all three trademarks of Ciba-Geigy) |
| 25 g. Lanasol Blue 3G | |

were added and dyeing was continued for only 30 minutes at the boil.

After this time, the fibres were examined and found to be correctly dyed. The dye liquor was run to waste and the fibres were rinsed and dried. It was found that the 250 kg. of the mixed fibre were prefectly dyed.

EXAMPLE 11

Approximately 7,500 liters of water in a Longclose Mark 5, two-stick, yarn dyeing machine were brought to pH 6.5 by the addition of 28 lbs. of disodium phosphate and 7 lbs. of monosodium phosphate. 7 kg. of Leveller N-R (trade mark of L. B. Holliday) were also introduced into the liquor. 180 kg. of wool yarn which had been chlorinated and treated with Hercoset (trade mark) 57 resin to enable it to withstand machine washings when subsequently knitted into garments, was introduced into this dyebath and pretreated for 40 minutes at 70° C. After this time, 600 g. of Lanasol Red G (trade mark of Ciba-Geigy) and 400 g. of Lanasol Orange G which had previously been dissolved in hot water at 80° C were added to the dye liquor. After the dyestuff had been added, the temperature was maintained at 70° C for 20 minutes, raised from 70° - 100° C in 10 minutes and dyed at 100° C for 45 minutes. At the end of this time, the yarn was given a cold rinse in a fresh dyebath after running the original dyebath to waste and the yarn upon drying was found to be perfectly level and on shade.

We claim:

1. A method of dyeing machine washable wool fibers, the fibers having been chlorinated and resin-treated to provide machine washability, the method comprising:

i. pre-treating the fibers in an aqueous bath containing a levelling agent for the dye, the pre-treatment being carried out at the dyeing temperature for a period of time in the range of from about 10 to 30 minutes, the dyeing temperature being in the range of from 70° C to the boiling point;

ii. adding to the bath a solution of a dyestuff material comprising at least one reactive dye, to form a dye bath; and iii. dyeing the pre-treated fibers in the dye bath at the dyeing temperature.

2. The method of claim 1 wherein the levelling agent is an amphoteric material selected from the group consisting of amphoteric polyglycol-ether derivitives and weakly cationic levelling agents.

3. A method according to claim 1 in which the bath in which the pre-treatment (i) is effected is buffered to a pH within the range of from about 4 to about 7.

4. A method according to claim 2 in which the bath is buffered to a pH within the range of from substantially 5.75 to substantially 6.5.

5. A method according to claim 1 in which a dyeing temperature is within the range of from about 70° C to about 100° C.

6. A method according to claim 1 in which at least one reactive dye selected from the group consisting of Anthraquinone and Azo dyestuffs having at least one reactive group is employed for said dyestuff material.

7. A method according to claim 6 in which said reactive group is selected from the group consisting of α-bromacryloylamino, monochlorotriazinyl, dichlorotriazinyl and chloroacetyl.

8. A method according to claim 1 in which said material to be dyed is selected from the group consisting of machine washable wools and machine washable wool mixtures.

* * * * *